United States Patent [19]

Ishizaki et al.

[11] Patent Number: 4,885,008

[45] Date of Patent: Dec. 5, 1989

[54] METHOD FOR IMPROVING COLD FLOW OF HYDROCARBON FUEL OILS

[75] Inventors: Takaharu Ishizaki; Taizo Igarashi, both of Nishinomiya City; Yasuo Urano, Amagasaki City; Yumiko Onodera, Nishinomiya City, all of Japan

[73] Assignee: Nippon Oil and Fats Company, Limited, Japan

[21] Appl. No.: 299,412

[22] Filed: Jan. 23, 1989

[30] Foreign Application Priority Data

Jan. 26, 1988 [JP] Japan ..... 63-14948

[51] Int. Cl.[4] ..... C10L 1/22

[52] U.S. Cl. ..... 44/62; 44/66; 44/71

[58] Field of Search ..... 44/62, 66, 71

[56] References Cited

U.S. PATENT DOCUMENTS

| | | | |
|---|---|---|---|
| 4,491,455 | 1/1985 | Ishizaki et al. | 44/62 |
| 4,509,954 | 4/1985 | Ishizaki et al. | 44/62 |
| 4,556,499 | 12/1985 | Heier et al. | 44/62 |
| 4,569,679 | 2/1986 | Rossi | 44/62 |
| 4,664,676 | 5/1987 | Denis et al. | 44/62 |
| 4,746,326 | 5/1988 | Smyser | 44/62 |

*Primary Examiner*—Jacqueline V. Howard

*Attorney, Agent, or Firm*—Arnold, White & Durkee

[57] ABSTRACT

A method is disclosed for improving low temperature cold flow of fuel oils by using a cross-linked ester compound consisting essentially of a nitrogen-containing compound having hydroxyl group, a straight chain fatty acid, and a cross-linking agent.

10 Claims, No Drawings

METHOD FOR IMPROVING COLD FLOW OF HYDROCARBON FUEL OILS

BACKGROUND OF THE INVENTION (1) Field of the Invention

The present invention relates to a method for improving the cold flow of hydrocarbon fuel oils.

(2) Related Art Statement

The oil prices have largely increased since the oil shock, which has greatly influenced all the industrial fields. Owing to this, many industries such as the steam power generation industry, the iron and steel industry, and the cement industry have tried to reduce or remove dependency of oils. As a result, demands for heavy oils mainly consumed in these industries have greatly been reduced. On the other hand, since middle or light fuel oils are mainly consumed in the living life and the transportation field, there is a tendency that demands therefor have increased to the contrary.

To cope with such changes in oil supply and demand situations, a number of countermeasures have been considered and practically carried out. As one of the countermeasures, a part of the heavy distillate is tried to be used for middle fuel oils. In particular, it is a strong tendency that the middle distillate fuel oils such as diesel gas oils and heating gas oils have become heavy.

As compared with the conventional fuel oils, such heavy middle distillate fuel oils contain a greater amount of paraffins having greater molecular weights, so that they are likely to precipitate the paraffins at low temperatures, and lose their cold flow at relatively high temperatures. Since large crystal grains of the paraffins are formed even at a temperature range in which the cold flow is maintained, filters or pipe lines in fuel oil systems of diesel engines or the like are plugged to interrupt smooth supply of the fuel oil.

In order to solve the above-mentioned problems, various cold flow improvers have heretofore been disclosed. For example, there are recited condensation products between chlorinated paraffins and naphthalene (U.S. Pat. No. 1,815,022), polyacrylates (U.S. Pat. No. 2,604,453), polyethylene (U.S. Pat. No. 3,474,157), a copolymer between ethylene and propylene (French Pat. No. 1,438,656), and a copolymer between ethylene and vinyl acetate (U.S. Pat. No. 2,048,479).

In the pour point test (JIS K 2269), these cold flow improvers exhibit relatively excellent pour point-lowering action. However, in the cold filter plugging point test (IP 309) for judging plugging of fuel oil filters at low temperatures, almost no effect is obtained in many of them. Particularly, the number of cold flow improvers which are effective for fuel oils containing much paraffins having high molecular weight is few.

It is difficult for the pour point test method to anticipate plugging of fuel oil filters due to paraffin crystal grains, which occur at temperatures much higher than the pour point. For this reason, the cold filter plugging point (hereinafter abbreviated as "CFPP") test has been contrived as an improved method of the conventional pour point test. It is an actual situation that the CFPP test are widely employed as a simple test method for evaluating practical low temperature cold flow of fuel oils.

The present inventors had repeatedly made studies to solve the problems regarding the abovementioned low temperature cold flow of the fuel oils. As a result, they found out that the CFPP is very effectively lowered by ester compounds in which an aminoic nitrogen atom is located in the center and in which a straight chain saturated hydrocarbon group is bonded to a site relatively near the aminoic nitrogen atom via an ester bond. This led to inventions disclosed in U.S. Pat. No. 4,509,954, European Pat. No. 117,108, Canadian Pat. No. 1,218,233, etc.

Although their inventions offer excellent cold flow improvers which effectively lower the CFPP of the above-mentioned fuels by a small addition amount, the kinds of fuels upon which the most excellent effects are afforded by the ester compounds of this type is limited, and optimum ester compounds need to be selected depending upon the kinds of fuel oils. For instance, it was found that an ester compound which exhibited the most excellent effect for No. 3 gas oil (guaranteed temperature: −20° C.) specified in JIS K 2204 could not be said to be the most preferable for No. 1 gas oil (guaranteed temperature: −5° C.), specified in JIS K 2204, and that another ester compound was the most preferable for the latter.

SUMMARY OF THE INVENTION

It is an object of the present invention to solve the problem in that the kinds of suitable fuel oils are limited as mentioned above, and to provide a method for improving the cold flow of a greatly wide range of fuel oils by using the above ester compounds cross-linked with cross-linking agents.

The cold flow improvers used in the present invention are fuel oil cold flow improvers which contain (A) a cross-linked ester each consisting of a nitrogen-containing compound having hydroxyl group, a straight chain saturated fatty acid, and a cross-linking agent, in the case that CFPP of fuel oils which are not lowered by ordinary cold flow improvers are to be lowered.

When the intended cold flow-improving effects include not only CFPP reduction but also sufficient PP reduction, the cold flow improvers used in the present invention are fuel oil cold flow improvers which each contain (A) the cross-linked ester, and (B) a polymer of one or more kinds of monomers selected from olefins, alkyl esters of ethylenically unsaturated carboxylic acids and vinyl esters of saturated fatty acids.

Alternatively, when the maximum effect is to be obtained in the case of the combination between (A) the cross-linked ester and (B) the polymer, the fuel oil cold flow improvers used in the present invention are fuel oil cold flow improvers which each contain (A) the cross-linked ester, (B) the polymer, and (C) an oil-soluble surface active agent.

These and other objects, features, and advantages of the invention will be appreciated upon reading of the following description of the invention, with the understanding that some modifications, variations and changes of the same could be made by the skilled person in the art to which the invention pertains without departing from the spirit of the invention or the scope of claims appended hereto.

DETAILED DESCRIPTION OF THE INVENTION

The invention will be explained in more detail below.

As the nitrogen-containing compounds having hydroxyl group, which constitute the cross-linked esters in the present invention, those containing not less than 2 hydroxyl groups are preferred. For example, mention may be made of alkanolamines, addition products of epoxides to alkanolamines, addition products of epoxides to alkylamines, addition products of epoxides to polyamines, alkanolamides of fatty acids, and addition products of epoxides to alkanolamides of fatty acids.

As the alkanolamines, mention may be made of diethanol amine, triethanol amine, diisopropanol amine, triisopropanol amine, dihydroxypropyl amine, bis(dihydroxypropyl)amine, and tri(dihydroxylpropyl)amine.

As the addition products of epoxides to alkanolamines, mention may be made of addition products of epoxides such as alkylene oxides, styrene oxide, and glycidol to the above alkanolamines, ethanolamine, and isopropanolamine. As the alkylene oxides used here, mention may be made of ethylene oxide, propylene oxide, and butylene oxide.

As the addition products of epoxides to alkylamines, mention may be made of addition products of the above-mentioned epoxide compounds to alkylamines such as methylamine, ethylamine, butylamine, octylamine, laurylamine, stearylamine, behenylamine, dimethylamine, diethylamine, dibutylamine, dioctylamine, dilaurylamine, distearylamine, dibehenylamine, laurylmethylamine, stearylethylamine, and behenyloctylamine.

As the addition products of epoxides to polyamines, mention may be made of the addition products of the above epoxide compounds to polyamines, for instance, ethylenediamine, propylenediamine, hexamethylenediamine, xylylenediamine, diethylenetriamine, triethylenetetramine, tetraethylenepentamine, pentaethylenehexamine, polyethylenimine, and addition products of ethylenimine to various compounds with which the above alkylamine, phenolic acid, hydrogen sulfide, mercaptan, and thiophenol which may effect a ring-opening addition reaction; and mention may also be made of addition products of the above epoxide compounds to polyamines which are partially converted to amides with $C_{1-30}$ fatty acids such as acetic acid, propionic acid, butyric acid, hexanoic acid, octanoic acid, pelargonic acid, decanoic acid, lauric acid, myristic acid, palmitic acid, stearic acid, arachic acid, behenic acid, lignoceric acid, cerotic acid, montanic acid, and melissic acid.

As the alkanolamides of fatty acids, mention may be made of diethanolamides, diisopropanolamide, dihydroxypropylamide, and bis(dihydroxypropyl)amide which are obtained in the form of amides with $C_{1-30}$ fatty acids such as acetic acid, propionic acid, butyric acid, hexanoic acid, octanoic acid, pelargonic acid, decanoic acid, lauric acid, myristic acid, palmitic acid, stearic acid, arachic acid, behenic acid, lignoceric acid, cerotic acid, monotanic acid, and melissic acid.

The addition products of epoxides to alkanolamides of fatty acids are addition products in which the above epoxide compounds are added to the above alkanolamides of fatty acids.

The addition of the epoxide compounds is effected by adding a single kind of an epoxide compound, by mixing and randomly adding two or more kinds of epoxide compounds, or by independently and in succession reacting them one by one.

The addition mole number of the epoxide compound is less than 50 moles, preferably less than 20 moles with respect to one mole of active hydrogen of the nitrogen-containing compound which have reactivity for the epoxide compound. If more than 50 moles of the epoxide compound is added, the CFPP reducing degree impractically becomes lower.

As the straight chain saturated fatty acids constituting the cross-linked esters in the present invention, mention may be made of $C_{10-30}$ fatty acids such as decanoic acid, lauric acid, myristic acid, palmitic acid, stearic acid, arachic acid, behenic acid, lignoceric acid, cerotic acid, montanic acid, and melissic acid. In addition, use may be made of hydrogenated beef tallow fatty acids, hydrogenated palm oil fatty acids, hydrogenated rapeseed oil fatty acid, coconut oil fatty acids, and hydrogenated fish oil fatty acids containing the above straight chain saturated fatty acids; fatty acids obtained by distillation or fractioning thereof; and synthesized fatty acids derived from $\alpha$-olefins.

As the cross-linking agents constituting the cross-linked esters in the present invention, use may be made of compounds having two or more reactive groups to react with hydroxyl groups, compounds having one or more reactive groups to bond to two or more hydroxyl groups, and combinations of these compounds. For example, mention may be made of compounds having two or more epoxide groups, isocyanate groups, carboxyl groups, acid halide groups, and/or groups of lower alcohol esters; polycarboxylic anhydrides; phosphoric esterification agents; and combinations thereof.

As the compounds having two or more reactive groups to bond to a hydroxyl group, mention may be made of polyisocyanates such as tolylene diisocyanate, xylene diisocyanate, hexamethylene diisocyanate, tolidine diisocyanate, naphthylene diisocyanate, diphenylmethane diisocyanate, decyclohexylmethane diisocyanate, isophorone diisocyanate, and triphenylmethane triisocyanate; polyepoxides such as ethylene glycol diglycidyl ether, propylene glycol diglycidyl ether, neopentylglycol diglycidyl ether, bisphenol A diglycidyl ether, polyethylene glycol diglycidyl ether, polypropylene glycol diglycidyl ether, glycerol polyglycidyl ether, trimethylolpropane polyglycidyl ether, and sorbitol polyglycidyl ether; polycarboxylic acids such as succinic acid, adipic acid, sebacic acid, dimer of oleic acid, maleic acid, phthalic acid, terephthalic acid, trimellitic acid, pyromellitic acid, polymer or copolymer of acrylic acid and methacrylic acid; acid halides of these polycarboxylic acids; lower alcohol esters such as methylesters of these polycarboxylic acids; and compounds having two or more different reactive groups in the same molecule such as phthalic acid monomethyl ester.

As the compounds having the reactive groups to bond to two or more hydroxyl groups, mention may be made of polycarboxylic anhydrides such as phthalic anhydride, maleic anhydride, and polymer or copolymer of maleic anhydride; phosphorus esterification agent such as phosphorus oxychloride, and phosphorus pentoxide; and compounds having two or more different reactive groups in the same molecule such as partially ring-opened reaction products between the polymer or copolymer of maleic anhydride and water.

Each of the cross-linked esters used in the present invention is obtained by esterifying the above nitrogen-containing compound having hydroxyl group with the above straight chain saturated fatty acid in an ordinary manner, and then cross-linking the above reaction product with the above cross-linking agent through utilization of remaining hydroxyl group having not undergone the above reaction. Alternatively, the cross-linked ester is obtained by preliminarily cross-linking the nitrogen-containing compound having hydroxyl group with the cross-linking agent, and esterifying the remaining hydroxyl group having not undergone this reaction with the straight chain saturated fatty acid according to an ordinary method. Or, as to some kinds of the cross-linking agents, the cross-linked esters may be obtained by charging the nitrogen-containing compound having hydroxyl group, the straight chain saturated fatty acid, and the cross-linking agent into a reactor together, and simultaneously effecting the esterification reaction and the cross-linking reaction.

The most effective ratios among the nitrogen containing compound having hydroxyl group, the straight chain saturated fatty acid, and the cross-linking agent to be used for the synthesis of the cross-linked esters in the present invention vary depending upon their kinds and the synthesizing method, and cannot be definitely specified. The straight chain saturated fatty acid and the cross-linking agent are not less than 0.5 mole, preferably not less than 1 mole, and not less than 0.2 mole, preferably not less than 0.5 mole, respectively, with respect to 1 mole of the nitrogen-containing compound having hydroxyl group.

The cross-linking is effected by heating at a temperature range from 40° to 150° C., preferably from 50° to 120° C. in the presence or in the absence of an inert solvent under stirring, when a polyisocyanate compound or a polyepoxide compound is used as the cross-linking agent. If necessary, an acid or a base catalyst which is ordinarily employed in ordinary cross-linking reactions may be used.

When a polycarboxylic acid, a polycarboxylic acid-lower alcohol ester or a polycarboxylic anhydride is used as the cross-linking agent, the cross-linking reaction is easily effected as desired by dehydration or removing a lower alcohol through heating in a temperature range from 60° to 250° C., preferably, from 100° to 200° C. in the presence or absence of an inert solvent under stirring, and in reduced pressure if necessary. In this case, an ordinary esterification reaction catalyst or an ester exchange reaction catalyst may be used to smooth the reaction.

When an acid halide of a polycarboxylic acid is used as the cross-linking agent, the cross-linking reaction is easily effected as desired by a condensation reaction in a temperature range from −10° to 150° C., preferably from 0° to 120° C. in the presence or absence of an inert solvent while passing an inert gas through the reaction system to facilitate removal of a hydrogen halide or with use of a known chemical easily capable of capturing the generated hydrogen halide.

When a phosphoric esterification agent such as phosphorus oxychloride or phosphorus pentoxide is used as the cross-linking agent, the cross-linking reaction can easily be effected as desired by reacting in a temperature range from −10° to 100° C., preferably from 0° to 60° C. in the presence or absence of an inert solvent while an inert gas is passed through the reaction system. In the case of phosphorus oxychloride, it is preferable that the reaction is carried out under slightly reduced pressure or through passing the inert gas at a sufficient flow rate so as to remove gaseous hydrochloric acid generated by the condensation reaction.

The olefins constituting the polymers in the present invention are $C_{2-30}$ olefins. Particularly, α-olefins are preferred. For example, mention may be made of ethylene, propylene, 1-butene,isobutene, 1-pentene, 1-hexene, 1-heptene, 1-octene, diisobutene, 1-dodecene, 1-octadecene, 1-eichosene, 1-tetracocene, and 1-triacontene.

The alkyl esters of ethylenically unsaturated carboxylic acids constituting the polymers are esters between monocarboxylic acids or dicarboxylic acids having ethylenically double bonds such as acrylic acid, methacrylic acid, itaconic acid, crotonic acid, maleic acid, and fumaric acid; and $C_{1-30}$ saturated alcohols.

The vinyl esters of saturated fatty acids constituting the polymers are esters between $C_{1-30}$ saturated fatty acids and vinyl alcohol, and mention may be made of vinyl formate, vinyl acetate, vinyl propionate, vinyl butyrate, vinyl hexanate, vinyl octanate, vinyl decanate, vinyl laurate, vinyl myristate, vinyl palmitate, vinyl stearate, vinyl arachinate, vinyl behenate, vinyl lignocerate, and vinyl melissate.

The polymers used in the present invention can be obtained by polymerizing one of the above-mentioned monomers or by copolymerizing a mixture of two or more kinds of them according to an ordinary method, a graft polymerization method with another monomer after the polymerization or copolymerization, a method of ester-exchanging a part or the entire part of ester sites after the polymerization or copolymerization in the case of the ester monomer, a method of esterifying the ethylenically unsaturated carboxylic acid or an anhydride thereof with an alcohol after the polymerization or copolymerization, or a method of chemically or physically modifying the polymer after the polymerization or copolymerization. Some of the above polymers are commercially available as fuel oil additives. The number average molecular weight of the polymers is preferably in a range from 500 to 500,000.

As the oil-soluble surface active agents used in the present invention, a variety of oil-soluble surface active agents which dissolve into fuel oils and which exhibit interface activity in the fuel oils at low temperatures at which the cold flow needs to be improved may be used among anionic, cationic, ampholytic, and nonionic surface active agents. When the surface active agents are to be added into the fuel oils, those not containing any element feared to cause troubles in practical use are preferred. Surface active agents are most preferably composed only of carbon, hydrogen, oxygen, nitrogen, sulfur, and the like which are inherently contained in fuel oils in great amounts.

Preferable surface active agents are preferably those which includes at least one kind of elements of an acid, an amine, an acid amine salt, an acid ammonium salt, a hydroxyl group, and an ether group per one molecule.

As the acids, mention may preferably be made of a carboxylic acid, a sulfonic acid, a sulfuric ester, and a phenolic acid which each contain a hydrocarbon group having 6 or more carbon atoms. Concretely, mention may be made of hexanoic acid, lauric acid, oleic acid, isostearic acid, naphthenic acid, benzoic acid, alkyl or alkenyl succinic acid, petroleum sulfonic acid, olefin sulfonic acid, polyolefin sulfonic acid, alkylbenzene sulfonic acid, alkylnaphthalene sulfonic acid, alkyl sulfuric ester, and alkylphenol.

As the amines, primary amines, secondary amines, and tertiary amines which each have at least one hydrocarbon group with the total number of carbons being 6 or more are preferred. Mention may be made of octyl amine, dihexyl amine, tetradecylbutyl amine, decyldimethyl amine, di(2-ethylhexyl)amine, dodecylisobutyl amine, beef tallow alkyl amine, dicoconut oil alkyl amine, beef tallow alkyl dimethyl amine, and oleylbenzylamine.

As the salts of acids and amines or ammonium, (1) salts between organic acids such as carboxylic acids, sulfonic acids, sulfuric esters, and phenolic acids having hydrocarbon group of 8 or more carbon atoms and amines or ammonium, and (2) salts between amines such as primary amines, secondary amines, and tertially amines having one or more hydrocarbons of 8 or more carbons and carboxylic acids, sulfonic acids, phenolic acid, or sulfuric acids are preferred. For instance, mention may be made of dodecyl amine salt of myristic acid, dodecylamine salt of naphthanic acid, dioctadecylamine salt of benzoic acid, beef tallow alkyl amine salt of dodecylbenzene sulfonic acid, ammonium salt of 2-ethylhexylnaphthalene sulfonic acid, ethylenediamine salt of polybutene sulfonic acid, dibutylamine salt of petroleum sulfonic acid, ammonium salt of 1,2-bis(-dodecyloxycarbonyl)-l-ethane sulfonic acid, tributylamine salt of oleyl sulfuric ester, dicoconut oil alkylamine salt of 2-ethylhexylphenol, dibeef tallow alkylamine salt of dibeef tallow alkylamide Of alkenyl ($C_{15-21}$) succinic acid, dodecylamine salt of monolauryl maleate, dioctadecylamine salt of propionic acid, behenylamine salt of phenol, dicoconut oil alkylamine salt of hexanoic acid, beef tallow alkylamino isopropylamine salt of oleic acid, octadecylimidazoline salt of acetic acid, dirapeseed oil alkylamine salt of sulfuric acid, dibeef tallow alkylamine salt of acetic acid, and hydroxyethyl beef tallow alkyl amine salt of lauric acid.

As the compounds having hydroxyl group or ether group, use may preferably be made of alcohols with hydrocarbon group having 6 or more carbon atoms, partially esterified compounds between alcohols having 2 or more hydroxyl groups and carboxylic acids, sulfonic acids, sulfuric esters, or phenolic acids each having a hydrocarbon group of 8 or more carbon atoms, addition products of ethyleneoxides, propyleneoxides, butyleneoxides, styreneoxides or glycidols to amines, amides, alcohols, acids or esters each having hydrocarbon group of 8 or more carbon atoms, condensation products between alkanol amines and carboxylic acids, sulfonic acids, sulfuric esters, or phenolic acid with hydrocarbon group having 8 or more carbon atoms, polymers or copolymers of a compound or compounds selected from epoxides such as ethyleneoxide, propyleneoxide, butyleneoxide, styreneoxide, or glycidol. For instance, mention may be made of oleyl alcohol, dioctylamine salt of hydroxystearic acid, sorbitan trioleate, glycerol diester of coconut oil fatty acid, polyoxyethylene (4 moles) dibeef tallow alkylamine, behenylaminoisopropyl dihydroxypropyl amine, polyoxypropylene (4 moles) lauryl diethanol amide, polyethyleneglycol (MWn=150) monoester of beef tallow fatty acid, polyoxyethylene (2 moles) sorbitan diester of oleic acid, diethanol amide of beef tallow fatty acid, copolymer of ethyleneoxide (10 moles) and propylene oxide (30 moles).

As mentioned above, the present invention is directed to the fuel oil cold flow improvers containing (A) a cross-linked esters each consisting essentially of the nitrogen-containing compound having hydroxyl group, the straight chain saturated fatty acid, and the cross-linking agent. Depending upon the intended cold flow-improving effects, the invention is directed to the fuel oil cold flow improvers each consisting essentially of (A) the cross-linked ester, (B) a polymer of one or more kinds of monomers selected from the group consisting of olefins, alkyl esters of ethylenically unsaturated carboxylic acids and vinyl esters of saturated fatty acids. Alternatively, the invention is directed to the fuel oil cold flow improvers each consisting essentially of (A) the cross-linked ester, (B) the polymer, and (C) an oil-soluble surface active agent.

In order to most effectively attain the object of the present invention, it is necessary to select species and optimum mixing ratios of the above-mentioned ingredients. In order to attain the objects of the present invention in the case of combining (A) the cross-linked ester and (B) the polymer, or in the case of combining (A) the cross-linked ester, (B) the polymer, and (C) the oil-soluble surface active agent, sufficient effects due to the combination cannot be obtained if each of the ingredients combined is not less than 1% by weight. It is preferable that each of the ingredients is not less than 10% by weight.

The fuel oils intended in the present invention are hydrocarbon fuel oils which are liquid at ordinary temperature, or those which are converted to liquid when being slightly heated. In addition, those intended in the present invention may include distillate fuel oils distilled from crude petroleum under ordinary pressure or reduced pressure, fuel oils having undergone various decomposition processes such as a fluid catalytic cracking, fuel oils having undergone various hydrogenation processes such as a hydrocracking, or combinations thereof. More preferably, the invention is directed to middle distillate fuel oils.

If the addition amount of the cold flow improver with respect to the fuel oil is less than 1 ppm in terms of weight, any effect due to the addition cannot be obtained. The addition amount is preferably in a range from 10 to 5,000 ppm.

According to the cold flow improvers of the present invention, an antioxidant, a corrosion inhibitor, a combustion improver, a sludge inhibitor, other cold flow improver, etc., which are added into ordinary oils may be used in combination therewith.

When the cold flow improver of the present invention is added to the fuel oil, the cold flow of the fuel oil at low temperatures can greatly be improved. Further, since other characteristics of the fuel oils are not adversely affected by the above addition, great advantages can be obtained in the production of the fuel oil. In particular, since the various problems regarding the cold flow at low temperatures, which occur during storage or transportation of heavy fuel oils containing much paraffins having relatively high molecular weight can be solved. Moreover, since the excellent quality of the fuel oils can be assured even when the fuel oils are converted to high molecular weight fuel oils, the present invention can greatly contribute to increased production of middle distillate fuel oils. Furthermore, since the range of the fuel oils to which the cold flow improvers of the present invention can suitably be applied is exceedingly wide, inconvenience that the cold flow improvers must be selectively used depending upon the kinds of the fuel oils, which is practically very inconvenient, is greatly reduced.

The present invention will be explained in more detail with reference to specific examples.

The following Table 1 shows names and mixing ratios of starting materials and synthesis methods with respect to cross-linked esters and non-cross-linked esters in Examples and Comparative Examples, respectively. EO and PO appearing in the names of the compounds denote ethylene oxide and propylene oxide, respectively.

In Table 2, polymers used in Examples and Comparative Examples are given.

In Table 3, oil-soluble surface active agents used in Examples and Comparative Examples are shown.

The cross-linked esters, the non-cross-linked esters, the polymers, and the surface active agents were prepared in the following methods.

Ester 1

Ester 1 was obtained with the materials shown in Ester 1 in Table 1. At first, triethanolamine and behenic acid were heated at 185° C. under stirring in nitrogen gas stream, and esterification was effected for 10 hours while distilled water was being removed. After all the esterified product was dissolved into 1,000 g of xylene, the solution was heated under stirring at 100° C. in nitrogen gas stream, to which hexamethylene diisocyanate was gradually added in two hours for crosslinking. Further, the reaction mixture was heated under stirring in nitrogen gas stream, and Ester 1 was obtained by removing distilled xylene.

Ester 2

Ester 2 was obtained with the materials shown in Ester 2 in Table 1 in the same manner as in Ester 1.

Ester 3

Ester 3 was obtained with the materials shown in Ester 3 in Table 1. At first stearylbis(dihydroxypropyl-)amine was dissolved into 1,000 g of xylene, which was heated at 120° C. under stirring in nitrogen gas stream, while ethylene glycol diglycidyl ether was gradually added in 5 hours for cross-linking. Then, the cross-linked product and hydrogenated rapeseed oil fatty acids were heated at 185° C. under stirring for 10 hours, while distilled water and xylene were being removed. Thereby, Ester 3 was obtained.

Ester 4

Ester 4 was obtained with the materials shown in Ester 4 in Table 1 in the same manner as in Ester 1 except that cross-linking was effected at 120° C. for 5 hours.

Ester 5

Ester 5 was obtained with the materials shown in Ester 5 in Table 1 in the same manner as in Ester 3 except that xylene was not used and that cross-linking was effected at 185° C. for 5 hours.

Ester 6

Ester 6 was obtained with the materials shown in Ester 6 in Table 1 in the same manner as in Ester 3 except that cross-linking was effected at 80° C. for 2 hours and that removal of hydrochloric acid was sufficiently effected after esterification. In removal of hydrochloric acid, the reaction product was dissolved into 1,000 g of xylene, which was washed with 1,000 ml of a 10% NaOH aqueous solution at 50° C. and sufficiently washed with a great amount of water at 50° C., and heated at 185° C. under stirring to remove distilled xylene and water.

Ester 7

Ester 7 was obtained with the materials shown in Ester 7 in Table 1. At first, stearyl diethanolamide, hydrogenated rapeseed oil fatty acids and maleic anhydride were heated at 185° C. under stirring in nitrogen gas stream, and esterification and crosslinking were effected for 10 hours while distilled water was being removed. Thereby, Ester 7 was obtained.

Ester 8

Ester 8 was obtained with the materials shown in Ester 8 in Table 1 in the same manner as in Ester 7 except that methyl alcohol was removed in addition to distilled water.

Ester 9

Ester 9 was obtained with the materials shown in Ester 9 in Table 1 in the same manner as in Ester 1 except that cross-linking was effected at 80° C. for 1 hour.

Esters 10–18

Each of Esters 10 to 18 was obtained by esterifying with the corresponding materials shown in Ester 10 to 18 in Table 1 by heating at 185° C. for 10 hours under stirring in nitrogen gas stream, while distilled water was being removed.

Polymer 1

Amoco-547D (low temperature cold flow improver manufactured by Amoco Chemicals, Co., Ltd. in U.S.A.) was dissolved in an excess amount of acetone, which was allowed to be left at 10° C. for 24 hours as it was. After a precipitate was removed, the remainder was dried under reduced pressure (140° C., 5 mmHg, 5 hours), thereby obtaining Polymer 1.

Polymer 2

47 g of ACP-5120 (Allied Chemical Co., Ltd. in U.S.A.) as a copolymer of ethylene and acrylic acid, 12 g of fatty alcohol derived from coconut oil fatty acid (Hydroxyl value: 280), 12 g of fatty alcohol derived from hydrogenated sardine oil fatty acid (Hydroxyl value 190), 0.2 g of paratoluene sulfonic acid, and 20 g of xylene were heated under stirring in nitrogen gas stream while xylene was being refluxed, and esterification was effected for 20 hours with distilled water being removed. After the esterification, Polymer 2 was obtained by removing distilled xylene. Polymer 3

ACRYLOID 152 (manufactured by Rohm And Haas Co., Ltd.) itself as a polyalkylmethacrylate was used as Polymer 3.

Polymer 4

2 liters/hour of hexane, 1 liter/hour of a hexane solution of vanadium trichloride (4 mmoles/liter), and 1 liter/hour of a hexane solution of sesquiethyl aluminum sesquichloride (32 mmoles/liter) were continuously charged through an upper portion of a 4 liters autoclave as a reactor, while the reaction liquid was continuously extracted through a lower portion of the reactor so that the reaction liquid inside the rector might always be 2 liters and a mixed gas of ethylene, propylene, and hydrogen (ethylene:propylene:hydrogen = 130 liters/-hour:50 liters/hour:120 liters/hour) was fed through the upper portion. The reaction was continuously effected at 35° C. As to the extracted reaction liquid, a small amount of methyl alcohol was added to terminate the reaction, and it was washed with water three times. Then, Polymer 4 was obtained by distilling off hexane.

Polymer 5

ACP-1702 itself (manufactured by Allied Chemical Co., Ltd. in U.S.A., Average molecular weight:; 1,100, Softening point: 85° C.) as a branched polyethylene was used as Polymer 5.

Polymer 6

While a mixture of 210 g (1 mole) of α-olefin (Number of carbons: 10–20), 98 g (1 mole) of maleic anhydride, and 500 g of xylene was heated in nitrogen gas stream with xylene being refluxed, a solution of 4 g of di-t-butylperoxide dissolved into 50 g of xylene was gradually added thereto. After the polymerization reaction was continued in this state for 10 hours, 421 g (2.1 moles) of fatty alcohol derived from coconut oil fatty acid (Hydroxyl value: 280) and 2 g of paratoluene sulfonic acid were added. Then, esterification reaction was carried out for 10 hours while xylene was being refluxed, and Polymer 6 was obtained by distilling off xylene.

Surface active agent 1

500 g of mixed α-olefins having the number of carbons in a range from 10 to 24 (Average number of carbons=17) and 98 g of maleic anhydride were charged into an autoclave. After substitution with nitrogen, the mixture was heated at 200° to 220° C. for 10 to 12 hours under stirring, thereby obtaining alkenylsuccinic anhydride. To the thus obtained reaction product was added 1,000 g of a 10 wt % NaOH aqueous solution at 100° C. under stirring to open anhydride rings. Then, a 36 wt % HCl aqueous solution continued to be added at room temperature until pH reached lower than 1. Then, the reaction mixture was allowed to be left as it was, and an aqueous layer was removed. Water was added to the remainder, which was washed with water and allowed to be left, followed by removal of an aqueous solution, again. This washing step was further repeated twice. Thereafter, the remainder was heated at 200° C. under reduced pressure of 10 mmHg to remove excess olefin and water, thereby obtaining Surface active agent 1.

Surface active agent 2

262 g of beef tallow alkyl ABT2) manufactured by Nippon Oil & Fats Co., Ltd. and 3 g of a nickel catalyst were charged into an autoclave. After substitution with nitrogen, the mixture was heated at 180° to 220° C. under stirring. While hydrogen gas was blown, a gas phase was simultaneously evacuated such that the pressure inside the autoclave might be kept at 10 kg/cm$^2$. By continuing the reaction for 15 hours to effect secondary amine conversion, Surface active agent 2 was obtained.

Surface active agent 3

500 g of aromatic petroleum oil (average molecular weight: about 300, aromatic content: about 40 wt %), which was obtained as a byproduct having a greater aromatic content in the solvent refining process of petroleum lubricants, was heated at 80° C. under stirring, while diluting nitrogen containing 7 vol % of $SO_3$ was gradually blown to effect sulfonation and blowing $SO_3$ in the total blow amount of 100 g in one hour. Then, an insoluble precipitate was removed from the sulfonated product, to which dibutylamine was added for neutralization such that pH of an 1% aqueous solution was near 7. Surface active agent 3 is a product thus neutralized.

Surface active agent 4

Surface active agent 4 was obtained by neutralizing naphtenic acid (Acid value: 160) purchased from Katayama Kagaku Kogyo Kabushiki Kaisha with dodecyl amine.

Surface active agent 5

While 360 g of a low molecular weight polymer of butene was heated at 50° C. under stirring, diluting nitrogen gas containing 7 vol % of $SO_3$ was gradually blown. By blowing SO3 in a total amount of 80 g in one hour, sulfonization was effected. Surface active agent 5 was obtained by neutralizing the sulfonated product with triethylamine.

Surface active agent 6

Surface active agent 6 was obtained by mixing an addition product of ethylene oxide (1 mole) of beef tallow alkyl amine (Amine $ABT_2$) manufactured by Nippon Oil & Fats Co., Ltd. and Coconut fatty acid (NAA-415) also manufactured by Nippon Oil & Fats Co., Ltd. in an equal molar ratio.

Surface active agent 7

Oleylimidazoline was obtained by mixing oleic acid (NAA-38) manufactured by Nippon Oil & Fats Co., Ltd. and ethylene diamine at an equal molar ratio, gradually rising the temperature up to 240° C. under stirring while distilled water was being removed, and further continuing heating at 240° C. for 4 hours. Surface active agent 7 was obtained by mixing oleic acid into the reaction product at the equal molar ratio.

Surface active agent 8

Surface active agent 8 is sorbitan tolyolate (Nonion OP-85R) manufactured by Nippon Oil & Fats Co., Ltd.

Surface active agent 9

Surface active agent 9 is an addition product of ethylene oxide (10 moles) to polypropylene glycol (Average molecular weight: 2,000, uniol D-2000) manufactured by Nippon Oil & Fats Co., Ltd.

Table 5 shows measurement values of CPFF when each of the cross-linked esters and the non-cross-linked esters was added to every one of Fuel Nos. 1–7. It is seen that when the cross-linking was effected by using the cross-linking agent, an excellent CFPP-lowering effect can be obtained over an entire range from heavy fuel oils (having high CFPP when no ester is added) to light fuel oils (having low CFPP when no ester is added).

Table 6 shows cases where the above esters were each used in combination with the respective polymers. In these cases, it is seen that the cross-linked esters exhibited excellent effects (CFPP-lowering effect and pour point-lowering effect) due to the addition.

Table 7 shows the cases where the esters were used in combination with the polymers and the oilsoluble surface active agents. It is seen that more excellent effects due to the addition can be obtained as compared with the cases using the esters and polymers in combination.

TABLE 1(a)

| | | Esters | | | |
|---|---|---|---|---|---|
| | | Ester starting material | | | Reaction process |
| | | Nitrogen-containing compound having hydroxyl group | Straight chain saturated fatty acid | Cross-linking agent | |
| Cross-linked esters | Ester 1 | 1 mole of triethanolamine | 1.2 moles of behenic acid | 0.9 mole of hexamethylene diisocyanate | 1 |
| | Ester 2 | 1 mole of blocked addition product of PO (6 moles) and EO (6 moles) to isopropanolamine | 1.2 moles of arachic acid | 0.9 mole of naphthylene diisocyanate | 1 |
| | Ester 3 | 1 mole of addition product of glycidol (2 moles) to stearylamine | 1.5 moles of behenic acid | 0.8 mole of ethylene glycol diglycidyl ether | 2 |
| | Ester 4 | 1 mole of addition product of EO (8 moles) to ethylenediamine | 2 moles of hydrogenated rapeseed oil fatty acid | 0.9 mole of neopentylglycol diglycidol ether | 1 |
| | Ester 5 | 1 mole of addition product of PO (50 moles) to polyethylenimine (molecular weight 300) | 3 moles of hydrogenated sardine oil fatty acid | 1 mole of dimer of oleic acid | 2 |
| | Ester 6 | 1 mole of addition product of EO (10 moles) to monoamide of diethylene-triamine and behenic acid | 1 mole of linear synthetic fatty acid (C16-30) | 1 mole of dichloride of adipic acid | 2 |
| | Ester 7 | 1 mole of diethanol amide of stearic acid | 1 mole of hydrogenated rapeseed oil fatty acid | 0.5 mole of maleic anhydride | 3 |
| | Ester 8 | 1 mole of addition product of PO (10 moles) to diisopropanolamide of behenic acid | 1 mole of hydrogenated sardine oil fatty acid | 0.5 mole of dimethyl ester of terephthalic acid | 3 |
| | Ester 9 | 1 mole of addition product of EO (3 moles) to triethanolamine | 0.5 mole of behenic acid, 0.5 mole of arachic acid | 1 mole of phosphorus pentoxide | 1 |

TABLE 1(b)

| | | Esters | | | |
|---|---|---|---|---|---|
| | | Ester starting material | | | Reaction process |
| | | Nitrogen-containing compound having hydroxyl group | Straight chain saturated fatty acid | Cross-linking agent | |
| Non-cross-linked esters | Ester 10 | 1 mole of triethanolamine | 1.2 moles of behenic acid | — | 4 |
| | Ester 11 | 1 mole of blocked addition product of PO (6 moles) and EO (6 moles) to isopropanolamine | 1.2 moles of arachic acid | — | 4 |
| | Ester 12 | 1 mole of addition product of glycidol (2 moles) to stearylamine | 1.5 moles of behenic acid | — | 4 |
| | Ester 13 | 1 mole of addition product of EO (8 moles) to ethylenediamine | 2 moles of hydrogenated rapeseed oil fatty acid | — | 4 |
| | Ester 14 | 1 mole of addition product of PO (50 moles) to polyethylenimine (molecular weight 300) | 3 moles of hydrogenated sardine oil fatty acid | — | 4 |
| | Ester 15 | 1 mole of addition product of EO (10 moles) to monoamide of diethylene | 1 mole of linear synthetic fatty acid (C16-30) | — | 4 |
| | Ester 16 | 1 mole of diethanol amide of stearic acid | 1 mole of hydrogenated rapeseed oil fatty acid | — | 4 |
| | Ester 17 | 1 mole of addition product of PO (10 moles) to diisopropanolamide of behenic acid | 1 mole of hydrogenated sardine oil fatty acid | — | 4 |
| | Ester 18 | 1 mole of addition product of EO (3 moles) to triethanolamine | 0.5 mole of behenic acid, 0.5 mole of arachic acid | — | 4 |

Reaction process 1: (present invention) After a nitrogen-containing compound having two or more hydroxyl groups was reacted with a straight chain saturated fatty acid, the reaction product was cross-linked with a crosslinking agent.
Reaction process 2: (present invention) After a nitrogen-containing compound having two or more hydroxyl groups was cross-linked with a crosslinking agent, the reaction product was esterified with a straight chain saturated fatty acid.
Reaction process 3: (present invention) A nitrogen-containing compound having two or more hydroxyl groups, a straight chain saturated fatty acid, and a cross-linking agent were simultaneously charged into a reactor, and were reacted.
Reaction process 4: (comparison) A nitrogen-containing compound having two or more hydroxyl groups was esterified with a straight chain saturated fatty acid.

TABLE 2

| Polymers |
|---|
| Copolymer of ethylene and vinyl acetate |

TABLE 2-continued

| Polymers | |
|---|---|
| Polymer 1 | (number average molecular weight: 5,000, |

TABLE 2-continued

| Polymers | |
|---|---|
| | content of ethylene: 74 mol %) |
| Polymer 2 | Ester of copolymer of ethylene and acrylic acid (number average molecular weight: 3,500, acid value: 120) and mixed straight chain alcohol (60 mol % of coconut oil alkyl alcohol: 40 mol % of hydrogenated sardine oil alkyl alcohol) |
| Polymer 3 | Polyalkylmethacrylate (number average molecular weight: 17,000, number of carbons of alkyl groups: 12–20) |
| Polymer 4 | Copolymer of ethylene and propylene (number average molecular weight: 5,000, content of ethylene: 73 mol %) |
| Polymer 5 | Branched polyethylene (number average molecular weight: 1,100, softening point: 85° C.) |
| Polymer 6 | Ester of copolymer of α-olefin($C_{10-20}$) and maleic anhydride (number average molecular weight: 10,000) and coconut oil alkyl alcohol |

TABLE 3

| Oil-soluble surface active agent | |
|---|---|
| Surface active agent 1 | Alkenyl ($C_{10-24}$) succinic acid |
| Surface active agent 2 | Dibeef tallow alkyl amine |
| Surface active agent 3 | Dibutylamine salt of petroleum sulfonic acid (number average molecular weight: 400) |
| Surface active agent 4 | Dodecylamine salt of naphthenic acid |
| Surface active agent 5 | Triethylamine salt of polybutene (number average molecular weight: 360) sulfonic acid |
| Surface active agent 6 | Hydroxyethyl beef tallow alkylamine salt of coconut oil fatty acid |
| Surface active agent 7 | Oleylimidazoline salt of oleic acid |
| Surface active agent 8 | Sorbitan trioleate |
| Surface actrive agent 9 | Addition product of ethylene oxide (10 moles) to polypropylene glycol (number average molecular weight: 2,000) |

TABLE 4

| | Properties of test fuel oils | | | | | | |
|---|---|---|---|---|---|---|---|
| | Fuel oil 1 | Fuel oil 2 | Fuel oil 3 | Fuel oil 4 | Fuel oil 5 | Fuel oil 6 | Fuel oil 7 |
| CFPP (°C.) | +5 | +2 | −1 | −4 | −7 | −11 | −17 |
| Pour point (°C.) | +2.5 | 0 | −2.5 | −5 | −10 | −12.5 | −20 |
| Boiling point range (°C.) | | | | | | | |
| Initial boiling point | 275 | 257 | 238 | 228 | 210 | 188 | 166 |
| 10% distilled point | 288.5 | 281.5 | 273 | 261.5 | 247.5 | 239.5 | 190.5 |
| 50% distilled point | 320 | 316 | 311 | 298 | 291.5 | 285 | 261 |
| 90% distilled point | 355 | 351.5 | 343 | 340 | 329 | 320 | 303 |
| Final boiling point | 370 | 368 | 365 | 362 | 346.5 | 334.5 | 331 |

TABLE 5

| Added ester | Added Amount (ppm) | Effect obtained when a single ester was used CFPP (°C.) | | | | | | |
|---|---|---|---|---|---|---|---|---|
| | | Fuel oil 1 | Fuel oil 2 | Fuel oil 3 | Fuel oil 4 | Fuel oil 5 | Fuel oil 6 | Fuel oil 7 |
| Not added | — | +5 | +2 | −1 | −4 | −7 | −11 | −17 |
| Ester 1 | 100 | −5 | −8 | −9 | −11 | −15 | −21 | −29 |
| Ester 2 | 100 | −5 | −7 | −9 | −11 | −15 | −20 | −27 |
| Ester 3 | 100 | −4 | −7 | −8 | −11 | −14 | −19 | −26 |
| Ester 4 | 100 | −5 | −8 | −9 | −11 | −15 | −21 | −28 |
| Ester 5 | 100 | −5 | −8 | −9 | −11 | −15 | −20 | −27 |
| Ester 6 | 100 | −3 | −6 | −7 | −10 | −12 | −16 | −22 |
| Ester 7 | 100 | −2 | −5 | −7 | −11 | −13 | −17 | −23 |
| Ester 8 | 100 | −2 | −4 | −7 | −10 | −13 | −17 | −24 |
| Ester 9 | 100 | −5 | −8 | −9 | −11 | −15 | −21 | −29 |
| Ester 10 | 100 | −3 | −6 | −7 | −7 | −9 | −11 | −18 |
| Ester 11 | 100 | +4 | 0 | −2 | −7 | −12 | −17 | −23 |
| Ester 12 | 100 | +4 | −1 | −7 | −11 | −11 | −13 | −18 |
| Ester 13 | 100 | −1 | −4 | −8 | −8 | −9 | −12 | −18 |
| Ester 14 | 100 | +3 | −1 | −7 | −10 | −11 | −12 | −17 |
| Ester 15 | 100 | −1 | −4 | −5 | −6 | −8 | −11 | −17 |
| Ester 16 | 100 | 0 | −4 | −7 | −7 | −8 | −12 | −17 |
| Ester 17 | 100 | +4 | +1 | −5 | −6 | −12 | −13 | −18 |
| Ester 18 | 100 | +2 | −4 | −7 | −11 | −10 | −12 | −18 |

TABLE 6

| Effects obtained when an ester and a polymer were used in combination | | | | | | | | | | | |
|---|---|---|---|---|---|---|---|---|---|---|---|
| Material | | | | Effects obtained by addition (CFPP: °C., pour point: °C.) | | | | | | | |
| Ester | | Polymer | | Fuel oil 1 | | Fuel oil 3 | | Fuel oil 5 | | Fuel oil 7 | |
| Kind | Added (ppm) | Kind | Added (ppm) | CFPP | Pour point | CFPP | Pour point | CFPP | Pour point | CFPP | Pour point |
| Not added | — | Not added | — | +5 | +2.5 | −1 | −2.5 | −7 | −10.0 | −17 | −20.0 |
| Ester 1 | 100 | 1 | 100 | −4 | −10.0 | −9 | −12.5 | −15 | −20.0 | −27 | −32.5 |
| Ester 2 | 100 | 2 | 100 | −4 | −7.5 | −8 | −10.0 | −14 | −17.5 | −25 | −27.5 |
| Ester 3 | 100 | 6 | 100 | −3 | −7.5 | −7 | −10.0 | −12 | −17.5 | −24 | −30.0 |
| Ester 4 | 100 | 4 | 100 | −5 | −10.0 | −9 | −12.5 | −14 | −20.0 | −26 | −32.5 |
| Ester 5 | 100 | 1 | 100 | −4 | −10.0 | −8 | −12.5 | −14 | −22.5 | −25 | −32.5 |
| Ester 6 | 100 | 3 | 100 | −2 | −7.5 | −6 | −10.0 | −11 | −17.5 | −22 | −27.5 |
| Ester 7 | 100 | 5 | 100 | −2 | −5.0 | −6 | −7.5 | −11 | −15.0 | −21 | −25.0 |
| Ester 8 | 100 | 6 | 100 | −1 | −7.5 | −6 | −10.0 | −12 | −17.5 | −21 | −27.5 |
| Ester 9 | 100 | 4 | 100 | −5 | −10.0 | −9 | −12.5 | −14 | −20.0 | −26 | −32.5 |
| Ester 10 | 100 | 1 | 100 | −3 | −10.0 | −7 | −12.5 | −8 | −22.5 | −17 | −32.5 |
| Ester 11 | 100 | 2 | 100 | +5 | −10.0 | −1 | −12.5 | −12 | −17.5 | −22 | −27.5 |
| Ester 12 | 100 | 6 | 100 | +5 | −10.0 | −7 | −12.5 | −10 | −17.5 | −17 | −27.5 |
| Ester 13 | 100 | 4 | 100 | 0 | −10.0 | −8 | −12.5 | −9 | −22.5 | −18 | −32.5 |
| Ester 14 | 100 | 1 | 100 | +4 | −10.0 | −7 | −12.5 | −11 | −22.5 | −17 | −32.5 |
| Ester 15 | 100 | 3 | 100 | 0 | −7.5 | −4 | −10.0 | −8 | −20.0 | −17 | −30.0 |
| Ester 16 | 100 | 5 | 100 | +1 | −5.0 | −6 | −7.5 | −8 | −17.5 | −17 | −27.5 |
| Ester 17 | 100 | 6 | 100 | +5 | −10.0 | −5 | −10.0 | −12 | −17.5 | −17 | −27.5 |
| Ester 18 | 100 | 4 | 100 | +3 | −10.0 | −7 | −12.5 | −10 | −20.0 | −18 | −30.0 |

TABLE 7

| Effects obtained when an ester, a polymer and an oil-soluble surface active agent were used in combination | | | | | | | | | | | | | |
|---|---|---|---|---|---|---|---|---|---|---|---|---|---|
| Material | | | | | | Effects obtained by addition (CFPP: °C., pour point: °C.) | | | | | | | |
| Ester | | Polymer | | Oil-soluble surface active agent | | Fuel oil 1 | | Fuel oil 3 | | Fuel oil 5 | | Fuel oil 7 | |
| Kind | Added (ppm) | Kind | Added (ppm) | Kind | Added (ppm) | CFPP | Pour point | CFPP | Pour point | CFPP | Pour point | CFPP | Pour point |
| Not added | — | Not added | — | Not added | — | +5 | +2.5 | −1 | −2.5 | −7 | −10.0 | −17 | −20.0 |
| 1 | 100 | 1 | 100 | 1 | 100 | −6 | −12.5 | −11 | −17.5 | −16 | −22.5 | −29 | −35.0 |
| 2 | 100 | 2 | 100 | 2 | 100 | −6 | −12.5 | −11 | −15.0 | −16 | −22.5 | −27 | −32.5 |
| 3 | 100 | 6 | 100 | 3 | 100 | −5 | −12.5 | −10 | −17.5 | −15 | −22.5 | −26 | −35.0 |
| 4 | 100 | 4 | 100 | 4 | 100 | −6 | −15.0 | −11 | −17.5 | −16 | −25.0 | −28 | −35.0 |
| 5 | 100 | 1 | 100 | 5 | 100 | −6 | −15.0 | −11 | −17.5 | −16 | −27.5 | −28 | −35.0 |
| 6 | 100 | 3 | 100 | 6 | 100 | −4 | −10.0 | −8 | −12.5 | −13 | −20.0 | −23 | −30.0 |
| 7 | 100 | 5 | 100 | 7 | 100 | −4 | −7.5 | −8 | −10.0 | −14 | −17.5 | −23 | −27.5 |
| 8 | 100 | 6 | 100 | 8 | 100 | −4 | −10.0 | −8 | −12.5 | −14 | −20.0 | −22 | −30.0 |
| 9 | 100 | 4 | 100 | 9 | 100 | −6 | −12.5 | −11 | −15.0 | −16 | −25.0 | −29 | −35.0 |
| 10 | 100 | 1 | 100 | 1 | 100 | −4 | −12.5 | −8 | −15.0 | −8 | −27.5 | −17 | −35.0 |
| 11 | 100 | 2 | 100 | 2 | 100 | +5 | −15.0 | −1 | −17.5 | −14 | −22.5 | −24 | −32.5 |
| 12 | 100 | 6 | 100 | 3 | 100 | +5 | −15.0 | −8 | −17.5 | −12 | −22.5 | −17 | −32.5 |
| 13 | 100 | 4 | 100 | 4 | 100 | −2 | −15.0 | −9 | −20.0 | −9 | −27.5 | −18 | −35.0 |
| 14 | 100 | 1 | 100 | 5 | 100 | +4 | −15.0 | −8 | −20.0 | −13 | −27.5 | −17 | −35.0 |
| 15 | 100 | 3 | 100 | 6 | 100 | −2 | −10.0 | −5 | −12.5 | −8 | −22.5 | −17 | −32.5 |
| 16 | 100 | 5 | 100 | 7 | 100 | −1 | −7.5 | −6 | −10.0 | −8 | −20.0 | −17 | −30.0 |
| 17 | 100 | 6 | 100 | 8 | 100 | +5 | −12.5 | −6 | −12.5 | −13 | −20.0 | −17 | −30.0 |
| 18 | 100 | 4 | 100 | 9 | 100 | +2 | −12.5 | −9 | −15.0 | −11 | −25.0 | −19 | −35.0 |

What is claimed is:

1. A method for improving low temperature cold flow of fuel oils comprising a cross-linked ester compound consisting essentially of a nitrogen-containing compound having hydroxyl group, a straight chain saturated fatty acid, and a cross-linking agent to said fuel oils.

2. A method for improving low temperature cold flow of fuel oils comprising (A) a cross-linked ester compound and (B) a polymer, said cross-linked ester compound consisting essentially of a nitrogen-containing compound having hydroxyl group, a straight chain saturated fatty acid, and a cross-linking agent, and said polymer being composed essentially of at least one kind of a monomer selected from the group consisting essentially of an olefin, an alkyl ester of an ethylenically unsaturated carboxylic acid, and a vinyl ester of a saturated fatty acid to said fuel oils.

3. A method for improving low temperature cold flow of fuel oils comprising (A) a cross-linked ester compound, (B) a polymer, and (C) an oil-soluble surface active agent, said cross-linked ester compound consisting essentially of a nitrogen-containing compound having hydroxyl group, a straight chain saturated fatty acid, and a cross-linking agent, and said polymer being composed essentially of at least one kind of a monomer selected from the group consisting essentially of an olefin, an alkyl ester of an ethylenically unsaturated carboxylic acid, and a vinyl ester of a saturated fatty acid to said fuel oils..

4. A method according to claim 1, wherein the nitrogen-containing compound having hydroxyl group is a material selected from the group consisting essentially of alkanolamines, addition products of epoxides to alkanolamines, addition products of epoxides to alkylamines, addition products of epoxides to polyamines, alkanolamides of fatty acid, and addition products of epoxides to alkanolamides of fatty acids.

5. A method according to claim 1, wherein the straight chain saturated fatty acid is selected from the group consisting of $C_{10-30}$ fatty acids.

6. A method according to claim 1, wherein the cross-linking agent is a compound selected from the group consisting of a compound having two or more reactive groups bondable to a hydroxyl group, a compound having at least one reactive group bondable to at least two hydroxyl groups, and a combination thereof.

7. A method according to claim 1, wherein the cross-linking agent is a compound selected from the group consisting of a compound each having at least two epoxy groups, isocyanate groups, carboxyl groups, acid halides, and/or lower alcohol esters; polycarboxylic anhydride; phosphoric esterification agent; and a combination thereof.

8. A method according to claim 1, wherein the olefin is a compound selected from the group consisting of $C_{2-30}$ olefins.

9. A method according to claim 1, wherein the alkyl ester of an ethylenically unsaturated carboxylic acid is a compound selected from the group consisting of an ester between a monocarboxylic acid having ethylenically double bonds and a $C_{1-30}$ saturated alcohol, and an ester between a dicarboxylic acid having ethylenically double bond and a $C_{1-30}$ saturated alcohol.

10. A method according to claim 1, wherein the vinyl ester of a saturated fatty acid is an ester selected from the group consisting of an ester between $C_{1-30}$ saturated fatty acids and vinyl alcohol.

* * * * *